US006602387B1

(12) United States Patent
Loughran et al.

(10) Patent No.: US 6,602,387 B1
(45) Date of Patent: Aug. 5, 2003

(54) THICK AND SMOOTH MULTI-PLY TISSUE

(75) Inventors: Scott Thomas Loughran, Bad Soden (DE); Hasnaa Agouzoul, Eschborn (DE); Claudia Christiane Bollinger-Krause, Offenbach a.m. (DE); Marianne Malmbak, Idstein-Eschenhahn (DE); Anja Werth, Frankfurt am Main (DE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 10/130,185

(22) PCT Filed: Nov. 22, 2000

(86) PCT No.: PCT/US00/32197

§ 371 (c)(1),
(2), (4) Date: May 13, 2002

(87) PCT Pub. No.: WO01/38640

PCT Pub. Date: May 31, 2001

(30) Foreign Application Priority Data

Nov. 26, 1999 (EP) ..... 99123568

(51) Int. Cl.[7] ..... D21F 11/00; D21F 13/00

(52) U.S. Cl. ..... 162/117; 162/111; 162/112; 162/205; 162/206; 428/152; 428/153; 428/154

(58) Field of Search ..... 162/111, 112, 162/117, 205, 206; 428/152, 153, 154

(56) References Cited

U.S. PATENT DOCUMENTS

| | | | |
|---|---|---|---|
| 3,414,459 | A | 12/1968 | Wells |
| 3,547,723 | A | 12/1970 | Gresham |
| 3,554,862 | A | 1/1971 | Hervey et al. |
| 3,556,907 | A | 1/1971 | Nystand |
| 3,556,932 | A | 1/1971 | Coscia et al. |
| 3,556,933 | A | 1/1971 | Williams et al. |
| 3,650,882 | A | 3/1972 | Thomas |
| 3,700,623 | A | 10/1972 | Keim |
| 3,708,366 | A | 1/1973 | Donnelly |
| 3,738,905 | A | 6/1973 | Thomas |
| 3,772,076 | A | 11/1973 | Keim |
| 3,821,068 | A | 6/1974 | Shaw |
| 3,844,880 | A | 10/1974 | Meisel, Jr. et al. |
| 3,855,158 | A | 12/1974 | Petrovich et al. |
| 3,867,225 | A | 2/1975 | Nystrand |
| 3,899,388 | A | 8/1975 | Petrovich et al. |
| 3,953,638 | A | 4/1976 | Kemp |
| 3,994,771 | A | 11/1976 | Morgan, Jr. et al. |
| 4,100,017 | A | 7/1978 | Flautt, Jr. |
| 4,129,528 | A | 12/1978 | Petrovich et al. |
| 4,147,586 | A | 4/1979 | Petrovich et al. |
| 4,166,001 | A | 8/1979 | Dunning et al. |
| 4,191,609 | A | 3/1980 | Trokhan |
| 4,222,921 | A | 9/1980 | Van Eenam |
| 4,300,981 | A | 11/1981 | Carstens |
| 4,320,162 | A | 3/1982 | Schulz |
| 4,469,735 | A | 9/1984 | Trokhan |
| 4,483,728 | A | 11/1984 | Bauernfeind |
| 4,513,051 | A | 4/1985 | Lavash |
| 4,529,480 | A | 7/1985 | Trokhan |
| 4,610,743 | A | 9/1986 | Salmeen et al. |
| 4,610,915 | A | 9/1986 | Crenshaw et al. |
| 4,637,859 | A | 1/1987 | Trokhan |
| 4,959,125 | A | 9/1990 | Spendel |
| 5,059,282 | A | 10/1991 | Ampulski et al. |
| 5,245,025 | A | 9/1993 | Trokhan et al. |
| 5,277,761 | A | 1/1994 | Van Phan et al. |
| 5,364,504 | A | 11/1994 | Smurkoski et al. |
| 5,389,204 | A | 2/1995 | Ampulski |
| 5,429,686 | A | 7/1995 | Chiu et al. |
| 5,443,691 | A | 8/1995 | Phan et al. |
| 5,468,323 | A | 11/1995 | McNeil |
| 5,490,902 | A | 2/1996 | Schulz |
| 5,503,715 | A | 4/1996 | Trokhan et al. |
| 5,527,428 | A | 6/1996 | Trokhan et al. |
| 5,529,664 | A | 6/1996 | Trokhan et al. |
| 5,534,326 | A | 7/1996 | Trokhan et al. |
| 5,549,790 | A | 8/1996 | Van Phan |
| 5,556,509 | A | 9/1996 | Trokhan et al. |
| 5,580,423 | A | 12/1996 | Ampulski et al. |
| 5,609,725 | A | 3/1997 | Van Phan |
| 5,614,061 | A | 3/1997 | Van Phan et al. |
| 5,629,052 | A | 5/1997 | Trokhan et al. |
| 5,637,194 | A | 6/1997 | Ampulski et al. |
| 5,654,076 | A | 8/1997 | Trokhan et al. |

(List continued on next page.)

FOREIGN PATENT DOCUMENTS

| | | |
|---|---|---|
| EP | 0 264 676 | 4/1988 |
| WO | WO 95/11343 | 4/1995 |
| WO | WO 95/27429 | 10/1995 |
| WO | WO 97/44528 | 11/1997 |

OTHER PUBLICATIONS

Robert S. Ampulski et al., Methods for the Measurement of the Mechanical Properties of Tissue Paper, 1991 International paper Physics Conference, p. 19–30.

PCT International Search Report for PCT/US00/32197, date of mailing Apr. 9, 2001.

*Primary Examiner*—Steven P. Griffin
*Assistant Examiner*—M. Halpern
(74) *Attorney, Agent, or Firm*—Vladimir Vitenberg; C. Brant Cook; David M. Weinrich

(57) ABSTRACT

The present invention relates to a paper tissue, and in particular to facial tissue, and disposable handkerchiefs. Claimed and described is a paper tissue comprising at least two plies, characterized in that the paper tissue has a physiological surface smoothness parameter of less than 700 microns, preferably from 650 microns to 50 microns, more preferably from 650 microns to 300 microns and in combination has a caliper per ply of more than 0.09 mm, preferably from 0.09 mm to 0.5 mm, more preferably from 0.1 mm to 0.2 mm. In one preferred embodiment a three-ply tissue with embossed middle ply is provided. Further is a related process claimed and described.

11 Claims, No Drawings

U.S. PATENT DOCUMENTS 5,672,248 A 9/1997 Wendt et al.
5,674,663 A 10/1997 McFarland et al.
5,679,222 A 10/1997 Rasch et al.
5,693,187 A 12/1997 Ampulski et al.
5,709,775 A 1/1998 Trokhan et al.
5,714,041 A 2/1998 Ayers et al.
5,728,268 A 3/1998 Weisman et al.
5,776,307 A 7/1998 Ampulski et al.
5,795,440 A 8/1998 Ampulski et al.
5,804,036 A 9/1998 Phan et al.
5,804,281 A 9/1998 Phan et al.
5,814,190 A 9/1998 Van Phan
5,817,377 A 10/1998 Trokhan et al.
5,820,730 A 10/1998 Phan et al.
5,846,379 A 12/1998 Ampulski et al.
5,855,738 A 1/1999 Weisman et al.
5,855,739 A 1/1999 Ampulski et al.
5,861,082 A 1/1999 Ampulski et al.
5,865,950 A 2/1999 Vinson et al.
5,871,887 A 2/1999 Trokhan et al.
5,897,745 A 4/1999 Ampulski et al.
5,900,122 A 5/1999 Huston
5,904,811 A 5/1999 Ampulski et al.
5,906,710 A 5/1999 Trokhan
5,919,556 A 7/1999 Barnholtz
5,980,691 A 11/1999 Weisman et al.
6,162,327 A * 12/2000 Batra et al. ..... 162/109

* cited by examiner

THICK AND SMOOTH MULTI-PLY TISSUE

RELATED APPLICATIONS

The present application is a 371 application of International Application No. PCT/US00/32197 filed Nov. 22, 2000, which claims priority to European Application No. 99123568.0 filed Nov. 26, 1999.

FIELD OF THE INVENTION

The present invention relates to paper tissue, and in particular to facial tissue, and disposable handkerchiefs. In one preferred embodiment a three-ply tissue with embossed middle ply is provided.

BACKGROUND OF THE INVENTION

Paper webs or sheets, sometimes called tissue or paper tissue webs or sheets, or herein called paper tissue, find extensive use in modern society. Such items as facial and toilet tissues are staple items of commerce, all of which are herein referred to as paper tissue. It has long been recognised that important physical attributes of these products are their strength and thickness/caliper, their softness and smoothness, their absorbency, and their lint resistance. Research and development efforts have been directed to the improvement of each of these attributes without seriously affecting the others as well as to the improvement of two or three attributes simultaneously.

Softness and smoothness relate to the tactile sensation perceived by the consumer when holding a particular product, rubbing it across the skin, or crumpling it within the hands. This tactile sensation is a combination of several physical properties. One of the more important physical properties related to the softness and smoothness is generally considered by those skilled in the art to be the surface structure of the paper tissue from which the tissue product is made and which is best captured by the physiological surface smoothness (PSS) parameter as known e.g. from U.S. Pat. No. 5,855,738. As important for the tactile sensation of consumers is the thickness/caliper of a tissue product.

Strength is the ability of the product to maintain physical integrity and to resist tearing, bursting, and shredding under use conditions.

Absorbency is the measure of the ability of a product to absorb quantities of liquid, particularly aqueous solutions or dispersions. Overall absorbency as perceived by the consumer is generally considered to be a combination of the total quantity of a liquid a given mass of paper tissue will absorb at saturation as well as the rate at which the mass absorbs the liquid.

Lint resistance is the ability of the fibrous product, and its constituent webs, to bind together under use conditions, including when wet. In other Words, the higher the lint resistance is, the lower the propensity of the web to lint will be.

WO97/44528 discloses a multi-ply tissue product with high absorbency. Example 4 discloses a product where a patterned, relatively textured ply is disposed between two substantially unpatterned, relatively untextured plies.

EP 0 264 676 discloses a process for the manufacture of multi-ply paper sheets. Example 3 discloses a three-ply product made from wet-formed paper, where the inner web is provided from embossed paper with a weight of 18 g/m$^2$ and the outer webs are provided from calendered paper with a weight of 14 g/m$^2$. The plies are assembled by a cellulose ether adhesive applied by nozzles.

U.S. Pat. No. 5,855,738 discloses a process for making smooth paper tissue comprising a calendering step.

Relatively thick disposable paper products, namely in the form of paper handkerchiefs and facial tissues, are known. For example, Tempo™, sold by The Procter & Gamble Company, has a caliper of about 0.3 mm. A high caliper conveys the idea of high dry and wet strength to the consumer. A high wet strength, also referred to as wet burst strength, in particular prevents tearing or bursting which in turn results in contamination of the user's hand with mucus or other bodily fluids.

Even thicker disposable paper products are known and typically used as kitchen towels, such as Bounty™, sold by The Procter & Gamble Company, which has a caliper of about 0.7 mm and a wet burst strength which is greater than 200 g. However such kitchen towels to a considerable extent owe their caliper to embossing over the whole surface which results in a surface texture which is rough and does not provide a suitably smooth wiping surface for blowing the nose.

Other products with high wet burst strength and typically a relatively high caliper are those produced by through-air-drying. Though-air-drying facilities, however, are not available on conventional paper making machines and the provision of such equipment means a considerable financial investment.

In theory, the wet strength and caliper of a product can be increased by increasing the number of plies to 5, 6 or even more (instead of embossing or the like) and thereby maintaining a smooth outer surface. However, this approach would be very costly and also lead to a stiff product, hence compromising tactile perception.

In attempting to provide a very smooth surface it is common in the art to subject paper tissue to calendering. However, calendering always means a trade-off of caliper and softness for smoothness (as discussed e.g. in U.S. Pat. No. 5,855,738).

In view of the prior art there remains a need for a tissue product, in particular a facial tissue, which:

- combines optimal strength, namely wet burst strength, absorbency and lint resistance
- further gives an ideal tactile sensation of softness, smoothness and thickness
- is cost effective to manufacture and preferably can be manufactured on conventional paper machines
- optionally provides skin care benefits

SUMMARY OF THE INVENTION

The present invention relates to a paper tissue, and in particular to facial tissue, and disposable handkerchiefs. Claimed and described is a paper tissue comprising at least two plies, characterised in that the paper tissue has a physiological surface smoothness parameter of less than 700 microns, preferably from 650 microns to 50 microns, more preferably from 650 microns to 300 microns and in combination has a caliper per ply of more than 0.09 mm, preferably from 0.09 mm to 0.5 mm, more preferably from 0.1 mm to 0.2 mm. In one preferred embodiment a three-ply tissue with embossed middle ply is provided. Further is a related process claimed and described.

DETAILED DESCRIPTION OF THE INVENTION

According to the present invention, a cellulose fibrous structure is wet-laid using principles and machinery well-known in the art of paper-making. A suitable pulp furnish for the process of making the paper tissue substrate preferably contains papermaking fibres consisting essentially of cellulose fibres (commonly-known as wood pulp fibres) or cellulose-derived fibres (including, for example, rayon, viscose). Fibres derived from soft woods (gymnosperms or coniferous trees) and hard woods (angiosperms or deciduous trees) are contemplated for use in this invention. The particular species of tree from which the fibres are derived is immaterial. The wood pulp fibers can be produced from the native wood by any convenient pulping process. Chemical processes such as sulfite, sulphate (including the Kraft) and soda processes are suitable. Mechanical processes such as thermochemical (or Asplund) processes are also suitable. In addition, the various semi-chemical and chemi-mechanical processes can be used. Bleached as well as unbleached fibers are contemplated for use. Preferably no non-cellulosic fibres, such as latex, fibres are used.

The paper tissue according to the present invention may contain, as a highly preferred component a wet strength chemical agent. Preferably up to about 3.0%, preferably at least 0.5%, and more preferably at least 0.8% by weight, on a dry fiber weight basis, of wet strength chemical agent, such as water-soluble permanent and temporary wet strength resin, are contained.

Wet strength resins useful herein can be of several types. For example, Wesffelt described a number of such materials and discussed their chemistry in Cellulose Chemistry and Technology, Volume 13, at pages 813–825 (1979).

Usually, the wet strength resins are water-soluble, cationic materials. That is to say, the resins are water-soluble at the time they are added to the papermaking furnish. It is quite possible, and even to be expected, that subsequent events such as cross-linking will render the resins insoluble in water. Further some resins are soluble only under specific conditions, such as over a limited pH range. Wet strength resins are generally believed to undergo a cross-linking or other curing reactions after they have been deposited on, within, or among the papermaking fibres. Cross-linking or curing does not normally occur so long as substantial amounts of water are present.

Of particular utility are the various polyamide-epichlorohydrin resins. These materials are low molecular weight polymers provided with reactive functional groups such as amino, epoxy, and azetidinium groups. The patent literature is replete with descriptions of processes for making such materials, including U.S. Pat. No. 3,700,623, issued to Keim on Oct. 24$^{th}$ 1972, and U.S. Pat. No. 3,772,076, issued to Keim on Nov. 13$^{th}$ 1973.

Polyamide-epihydrochlorin resins sold under the trademarks Kymene 557 H and Kymene LX by Hercules Inc. of Wilmington, Del., are particularly useful in this invention. These resins are generally described in the aforementioned patents to Keim.

Base-activated polyamide-epichlorohydrin resins useful in the present invention are sold under the Santo Res trademark, such as Santo Re 31, by Monsanto Company of St. Louis, Mo. These types of materials are generally described in U.S. Pat. No. 3,855,158 issued to Petrovich on Dec. 17$^{th}$ 1974; U.S. Pat. No. 3,899,388 issued to Petrovich on Aug. 12$^{th}$ 1975; U.S. Pat. No. 4,129,528 issued to Petrovich on Dec. 12, 1978; U.S. Pat. No. 4,147,586 issued to Petrovich on Apr. 3$^{rd}$ 1979; and U.S. Pat. No. 4,222,921 issued to Van Eenam on Sep. 16$^{th}$ 1980.

Other water-soluble cationic resins useful hererin are the polyacrylamide resins such as those sold under the Parez trademark, such as Parez 631NC, by American Cyanamid Company of Sandford, Conn. These materials are generally described in U.S. Pat. No. 3,556,932 issued to Coscia et al on Jan. 19$^{th}$ 1971; and U.S. Pat. No. 3,556,933 issued to Williams et al on Jan. 19$^{th}$ 1971.

Other types of water-soluble resins useful in the present invention include acrylic emulsions and anionic styrene-butadiene latexes. Numerous examples of these types of resins are provided in U.S. Pat. No. 3,844,880. Meisel Jr et al, issued Oct. 29$^{th}$ 1974. Still other water-soluble cationic resins finding utility in this invention are the urea formaldehyde and melamine formaldehyde resins. These polyfunctional, reactive polymers have molecular weights on the order of a few thousand. The more common functional groups include nitrogen containing groups such as amino groups and methylol groups attached to the nitrogen. Although less preferred, polyethylenimine type resins find utility in the present invention.

More complete descriptions of the aforementioned water-soluble resins, including their manufacture, can be found in TAPPI Monograph Series No. 29, "Wet Strength in paper and Paperboard, Technical Association of the Pulp and Paper Industry (New York; 1965).

Temporary wet strength agents, such as modified starch may also, optionally, be used. Combinations of permanent and temporary wet strength agents may be used.

The present invention may contain dry strength chemical agents, preferably at levels up to 3% by weight, more preferably at least 0.1% by weight, on a dry fiber weight basis. A highly preferred dry strength chemical agent is carboxymethyl cellulose. Other suitable dry strength chemical agents include polyacrylamide (such as combinations of Cypro™ 514 and Accostrength™ 711 produced by American Cyanamid of Wayne, N.J.); starch (such as corn starch or potato starch); polyvinyl alcohol (such as Airvol™ 540 produced by Air Products Inc. of Allentown, Pa.); guar or locust bean gums; and polyacrylate latexes. Suitable starch materials may also include modified cationic starches such as those modified to have nitrogen containing groups such as amino groups and methylol groups attached to nitrogen, available from National Starch and Chemical Company (Bridgewater, N.J.).

Chemical softening compositions, comprising chemical debonding agents are optional components of the present invention. U.S. Pat. No. 3,821,068, issued Jun. 28$^{th}$, 1974 teaches that chemical debonding agents can be used to reduce the stiffness, and thus enhance the softness, of a paper tissue web. U.S. Pat. No. 3,554,862, issued on Jan. 12$^{th}$ 1971 discloses suitable chemical debonding agents. These chemical debonding agents include quaternary ammonium salts.

Preferred chemical softening compositions comprise from about 0.01% to about 3.0% of a quaternary ammonium compound, preferably a biodegradable quaternary ammonium compound; and from about 0.01% to about 3.0% of a polyhydroxy compound; preferably selected from the group consisting of glycerol, sorbitols, polyglycerols having an average molecular weight of from about 150 to about 800 and polyoxyethylene glycols and polyoxypropylene glycols having a weight average molecular weight from about 200 to 4000. Preferably the weight ratio of the quaternary ammonium compound to the polyhydroxy compound ranges from about 1.0:0.1 to 0.1:1.0. It has been discovered that the chemical softening composition is more effective when the polyhydroxy compound and the quaternary ammonium compound are first premixed together, preferably at a temperature of at least 40° C., before being added to the papermaking furnish. Either additionally, or alternatively, chemical softening compositions may be applied to the substantially dry paper tissue web, for example by means of a printing process (N.B. all percentages herein are by weight of dry fibres, unless otherwise specified).

Examples of quaternary ammonium compounds suitable for use in the present invention include either unmodified, or mono- or di-ester variations of:well-known dialkyldimethylammonium salts and alkyltrimethyl ammonium salts. Examples include the di-ester variations of di(hydrogenated tallow)dimethyl ammonium methylsulphate and di-ester variations of di(hydrogenated tallow)dimethyl ammonium chloride. Without wishing to be bound by theory, it is believed that the ester moity(ies) lends biodegradability to these compounds. Commercially available materials are available from Witco Chemical Company Inc. of Dublin, Ohio, under the tradename "Rewoquat V3512". Details of analytical and testing procedures are given in WO95/11343, published on Apr., $27^{th}$ 1995.

Examples of polyhydroxy compounds useful in the present invention include polyoxyethylene glycols having a weight average molecular weight of from about 200 to about 600, especially preferred is "PEG-400".

The paper tissue of the present invention may be made by common methods well-known to the person skilled in the art, such as by dewatering suitable pulp using, for example, one or more papermakers felts and/or belts. For the present invention conventional papermaking processes are preferred. Any process referred to herein as conventional is a paper-making process which does not comprise a step of through-air-drying. Alternatively, papermaking processes comprising a through-air-drying step can be utilised. Such processes are described in the patent literature referred to hereinafter with regard to through-air-dried tissue.

According to the present invention a paper tissue is provided from at least 2 plies which is thick but smooth and hence has a physiological surface smoothness parameter of less than 700 microns, preferably from 650 microns to 50 microns, more preferably from 650 microns to 300 microns and in combination has a caliper per ply of more than 0.09 mm, preferably from 0.09 mm to 0.5 mm, more preferably from 0.1 mm to 0.2 mm. According to the present invention it has been found that the caliper per ply is a relevant parameter in expressing how much caliper is provided in a cost effective way, i.e. per one ply. Any combination of ranges given above for the PSS parameter and the caliper per ply is within the scope of the present invention.

Preferably the paper tissue has a low ratio of caliper per ply over the PSS parameter, the ratio being lower than 6500 microns/mm, more preferably lower than 5000 microns/mm, yet more preferably lower than 3000 microns/mm.

A paper tissue according to the present invention has a first and a second surface, the surfaces being mutually opposed to each other, and a thickness orthogonal to the first and second surface. The thickness is also referred to a caliper of the tissue.

The caliper of a tissue according to the present invention is preferably from 0.1 mm to 1 mm, more preferably from 0.2 mm to 0.5 mm.

Moreover, a paper tissue according to the present invention has preferably a wet burst strength greater than 100 g, preferably from 150 g to 500 g, more preferably from 250 g to 400 g.

In one preferred embodiment of the present invention a paper tissue is provided from two plies. In one preferred two-ply embodiment of the present invention one ply is provided from a calendered paper tissue while the other ply is provided from a textured, preferably embossed paper tissue. Without wishing to be bound by theory, the following is believed: The embossing increases the overall caliper of the product and thereby also the caliper per ply. The calendering typically increases the smoothness of the respective ply and thereby a surface is provided with a low PSS parameter.

"Calendered", as used herein, comprises high pressure calendering, high pressure calendering denoting a calendering using a pressure per contact length of at least 3 kN/m, more preferably 5 kN/m to 50 kN/m, yet more preferably 10 kN/m to 25 kN/m. Calendering with higher pressure increases the smoothness of paper tissue and hence decrease the PSS parameter.

In accordance with the present invention preferably single plies are subjected to calendering, but alternatively several plies at a time or a whole multi-ply paper tissue may be calendered.

Alternatively other techniques known is the art to increase the smoothness of paper tissue can be used, such as the selection of appropriate Fourdrinier wires, felts, and belt in the dewatering stages, further creping under the appropriate conditions (glue content, glue composition, blade impact angle, creping aides). Further surface treatments, for example with a lotion, as disclosed hereinafter, are within the scope of the present invention.

"Textured", as used herein, for a paper tissue refers to a paper tissue which is either through-air-dried, or bulk embossed, or comprises regions of different basis weights or is dried with a texture or creped under the appropriate conditions (glue content, glue composition, blade impact angle, creping aides), as explained hereinafter.

"Bulk embossed", as used herein, refers to an embossing which increases the caliper of the paper tissue by at least 5%, preferably 15%, more preferably 25% as compared to the caliper of the paper tissue before the bulk embossing. Preferably bulk embossing provides a pattern of embossed and unembossed areas, which is imparted to only a limited number of plies of the multi-ply paper tissues of the present invention in one process step, preferably only to one ply in one process steps. The outermost embossed areas of the pattern preferably extends over at least 75%, preferably 85%, more preferably 95% of the total surface area of the embossed paper plies. Knob to knob embossing is well known in the art as illustrated by commonly assigned U.S. Pat. No. 3,414,459, issued Dec. 3, 1968 to Wells. The texture may also be imparted to the paper tissue by nested embossing as illustrated by U.S. Pat. No. 4,320,162, issued Mar. 16, 1982 to Schulz et al. Alternatively, the texture may be imparted to the paper tissue by dual ply lamination embossing as illustrated by commonly assigned U.S. Pat. No. 5,468,323, issued Nov. 21, 1995 to McNeil. Preferably such bulk embossing pattern is provided by steel-to-steel knob-to-knob embossing, the knobs preferably having an elliptical cross section and a height in the range of 0.5 mm to 3 mm, more preferably in the range of 1 mm to 2 mm. Preferably the bulk embossing provides a ratio of embossed areas to unembossed areas of from 1:1 to 1:20, more preferably 1:2 to 1:15, yet more preferably a ratio of from 1:5 to 1:10.

To obtain the texture on either, or both, of the first and second opposed surfaces, the tissue may be alternatively through-air-dried. Through-air-dried tissue is disclosed in commonly assigned U.S. Pat. No. 4,529,480, issued Jul. 16, 1985 to Trokhan; U.S. Pat. No. 4,637,859, issued Jan. 20, 1987 to Trokhan; U.S. Pat. No. 5,364,504, issued Nov. 15, 1994 to Smurkoski et al.; U.S. Pat. No. 5,529,664, issued Jun. 25, 1996 to Trokhan et al.; U.S. Pat. No. 5,679,222 issued Oct. 21, 1997 to Rasch et al.; U.S. Pat. No. 5,714,041 issued Feb. 3, 1998 to Ayers et al.; U.S. Pat. No. 5,906,710, issued May 25, 1999 to Trokhan. Alternatively, the paper tissue may be through-air-dried and made as disclosed in U.S. Pat. No. 5,429,686 issued Jul. 4, 1995 to Chiu et al. and U.S. Pat. No. 5,672,248 issued Sept. 30, 1997 to Wendt et al.

Alternatively, the paper tissue may be textured by providing various regions of differing basis weights, so that a multi-basis weight paper tissue is presented. Multi-basis weight paper tissue is disclosed in commonly assigned U.S. Pat. No. 5,245,025, issued Sep. 14, 1993 to Trokhan et al.; U.S. Pat. No. 5,527,428 issued Jun. 18, 1996 to Trokhan et al.; U.S. Pat. No. 5,534,326 issued Jul. 9, 1996 to Trokhan et al.; U.S. Pat. No. 5,654,076, issued Aug. 5, 1997 to Trokhan et al.; U.S. Pat. No. 5,820,730, issued Oct. 13, 1998 to Phan et al.; U.S. Pat. No. 5,277,761, issued Jan. 11, 1994 to Phan et al.; U.S. Pat. No. 5,443,691, issued Aug. 22, 1995 to Phan et al.; U.S. Pat. No. 5,804,036 issued Sep. 8, 1998 to Phan et al.; U.S. Pat. No. 5,503,715, issued Apr. 2, 1996 to Trokhan et al.; U.S. Pat. No. 5,614,061, issued Mar. 25, 1997 to Phan et al.; U.S. Pat. No. 5,804,281 issued Sep. 8, 1998 to Phan et al.; and U.S. Pat. No. 5,900,122 issued May 4, 1999 to Huston.

Alternatively, the paper may be conventionally dried with a texture, for example, according to commonly assigned U.S. Pat. No. 5,549,790, issued Aug. 27, 1996 to Phan; U.S. Pat. No. 5,556,509, issued Sept. 17, 1996 to Trokhan et al.; U.S. Pat. No. 5,580,423, issued Dec. 3, 1996 to Ampulski et al.; U.S. Pat. No. 5,609,725, issued Mar. 11, 1997 to Phan; U.S. Pat. No. 5,629,052 issued May 13, 1997 to Trokhan et al.; U.S. Pat. No. 5,637,194, issued Jun. 10, 1997 to Ampulski et al.; U.S. Pat. No. 5,674,663, issued Oct. 7, 1997 to McFarland et al.; U.S. Pat. No. 5,693,187 issued Dec. 2, 1997 to Ampulski et al.; U.S. Pat. No. 5,709,775 issued Jan. 20, 1998 to Trokhan et al.; U.S. Pat. No. 5,776,307 issued Jul. 7, 1998 to Ampulski et al.; U.S. Pat. No. 5,795,440 issued Aug. 18, 1998 to Ampulski et al.; U.S. Pat. No. 5,814,190 issued Sep. 29, 1998 to Phan; U.S. Pat. No. 5,817,377 issued Oct. 6, 1998 to Trokhan et al.; U.S. Pat. No. 5,846,379 issued Dec. 8, 1998 to Ampulski et al.; U.S. Pat. No. 5,855,739 issued Jan. 5, 1999 to Ampulski et al.; U.S. Pat. No. 5,861,082 issued Jan. 19, 1999 to Ampulski et al., 5,871,887 issued Feb. 16, 1999 to Trokhan et al.; U.S. Pat. No. 5,897,745 issued Apr. 27, 1999 to Ampulski, et al.; and U.S. Pat. No. 5,904,811 issued May 18, 1999 to Ampulski et al.

In a highly preferred embodiment of the present invention a paper tissue is provided from three plies. Preferably at least one ply is calendered and at least one ply is textured, preferably embossed. More preferably two plies are calendered and an embossed preferably is disposed therebetween. This particular embodiment has the advantage of providing a smooth surface to the user on either side. Alternative embodiments of the present invention are for example those with any number of textured, preferably embossed plies disposed between two outer calendered plies, one of these being a four ply paper tissue with two embossed plies disposed between two calendered plies.

When two or more plies of paper tissue are combined to form the paper tissue, the plies may, optionally, be attached together by means, for example, of gluing or embossing, herein referred to as "attachment embossing". Gluing is less preferred because it tends to result in a stiffer, less soft product. "Attachment embosssing", as used herein, refers to an embossing by which all plies of a multi-ply tissue according to the present invention are embossed in one process step. Preferably the attachment embossing does not or at least not to a large extent affect the smoothness of any calendered ply. Therefore, preferably the tissue has an unembossed surface over a major part of the surface area of the tissue, preferably on the first and the second surface. As used herein, this means that the tissue has one or more regions not comprising an attachment embossing and, optionally, one or more regions comprising an attachment embossing, and that the region not comprising an attachment embossing is at least 50%, and as much as 99%, of the surface area of the tissue. Most commonly the regions comprising an attachment embossing lie close to the edge of the tissue (for example along two or four edges); and a regions comprising an attachment embossing may also be used for decorative purposes (for example to create a pattern or to spell out a logo or brand name). The region not comprising an attachment embossing is the continuous region between and/or around the region comprising an attachment embossing. Attachment embossing is preferably done by steel-to-steel pin-to-pin embossing.

If glue is to be used to attach the plies of a multi-ply paper tissue, according to the present invention the glue is preferably applied unevenly over the surfaces of the plies to be attached. Therefore the glue is preferably not applied by means such a spraying nozzle, since such nozzles apply the glue evenly with no preference for particular areas of the tissue, even when the glue is applied as to form a discontinuous net.

A textured, preferably embossed, paper tissue comprises raised portions. In one preferred embodiment of the present invention the glue to applied only to these raised portions of the paper tissue. Since primarily these raised portions are in context with adjacent plies, in particular with adjacent calendered plies, application of glue to these raised portions is sufficient as to ensure good attachment, but avoids the application of an amount of glue, which easily impart stiffness to the paper tissue.

One preferred method of applying glue to a tissue ply is to apply the glue by print rolling. Alternatively glue may be applied by melt blowing, so as to form areas of preferential glue applications, e.g. strips of glue.

The paper tissue and preferably one or both surfaces, most preferably both surfaces of the tissue may, optionally, be further treated with a lotion. A lotion can contribute to the smoothness of the paper tissue, and hence decrease its PSS parameter.

The lotion may comprise softeningidebonding agents, emollients, immobilizing agents and mixtures thereof. Suitable softening/debonding agents include quaternary ammonium compounds, polysiloxanes, and mixtures thereof. Suitable emollients include propylene glycol, glycerine, triethylene glycol, spermaceti or other waxes, petrolatum, fatty acids, fatty alcohols and fatty alcohol ethers having from 12 to 28 carbon atoms in their fatty acid chain, and mixtures thereof. Suitable immobilizing agents include polyhydroxy fatty acid esters, polyhydroxy fatty acid amides and mixtures thereof. Other optional components include perfumes, antibacterial actives, antiviral actives, disinfectants, pharmaceutical actives, film formers, deodorants, opacifiers, astringents, solvents and the like. Particular examples of lotion components include camphor, thymol and menthol.

A process according to the present invention may utilise any paper tissue made by any method known in the art, preferred methods are disclosed herein.

The process comprises a step of supplying the paper tissue by unwinding at least two plies, preferably three plies, from a corresponding number of parent rolls. The process comprises a further step of applying a texture pattern to at least one ply, preferably by bulk embossing as disclosed herein. The process also comprises a step of high pressure calendering at least one ply using calendering pressures as disclosed herein. Further the process comprises a step of juxtaposing said plies to form a multi-ply tissue.

A more preferred process further comprises a step of applying lotion to the plies, which will form the outer plies of the mulit-ply paper tissue, most preferably the lotion is applied only to the surfaces which will form the outer surfaces of the multi-ply tissue. Moreover a preferred process comprises a step of attaching the juxtaposed plies by embossing, referred to and described above as attachment embossing. Optionally the present process may also comprise the application of glue, preferably only to the raised portions of the textured plies.

Test Methods

Caliper is measured according to the following procedure: The tissue paper is preconditioned at 21° to 24° C. and 48 to 52 percent relative humidity for two hours prior to the caliper measurement. If the caliper of toilet tissue is being measured, 15 to 20 sheets are first removed and discarded. If the caliper of facial tissue is being measured, the sample is taken from near the center of the package. The sample is selected and then conditioned for an additional 15 minutes.

Caliper of the multi-ply paper tissue, as used herein, is the thickness of the paper when subjected to a compressive load of 14.7 g/cm$^2$. Preferably, caliper is measured using a low load Thwing-Albert micrometer, Model 89-11, available from the Thwing-Albert Instrument Company of Philadelphia, Pa. The caliper per ply is the total caliper of the multi-ply paper tissue divided by the number of plies comprised. For a single ply tissue caliper per ply and caliper are identical. Decorated regions, perforations, edge effects, etc., of the tissue should be avoided if possible.

The wet burst strength is measured using an electronic burst tester and the following test conditions. The burst tester is a Thwing-Albert Burst Tester Cat. No. 177 equipped with a 2000 g load cell. The burst tester is supplied by Thwing-Albert Instrument Company, Philadelphia, Pa. 19154, USA.

Take eight paper tissues and stack them in pairs of two. Using scissors, cut the samples so that they are approximately 228 mm in the machine direction and approximately 114 mm in the cross-machine direction, each two finished product units thick.

First age the samples for one to two hours by attaching the sample stack together with a small paper clip and "fan" the other end of the sample stack to separate the sheets, this allows circulation of air between them. Suspend each sample stack by a clamp in a 107° C. (±3° C.) forced draft oven for 5 minutes (±10 seconds). After the heating period, remove the sample stack from the oven and cool for a minimum of three minutes before testing.

Take one sample strip, holding the sample by the narrow cross direction edges, dipping the centre of the sample into a pan filled with about 25 mm of distilled water. Leave the sample in the water four (4.0±0.5) seconds. Remove and drain for three (3.0±0.5) seconds holding the sample so the water runs off in the cross direction. Proceed with the test immediately after the drain step. Place the wet sample on the lower ring of the sample holding device with the outer surface of the product facing up, so that the wet part of the sample completely covers the open surface of the sample holding ring. If wrinkles are present, discard the sample and repeat with a new sample. After the sample is properly in place on the lower ring, turn the switch that lowers the upper ring. The sample to be tested is now securely gripped in the sample holding unit. Start the burst test immediately at this point by pressing the start button. The plunger will begin to rise. At the point when the sample tears or ruptures, report the maximum reading. The plunger will automatically reverse and return to its original starting position. Repeat this procedure on three more samples for a total of four tests, i.e., 4 replicates. Report the results, as an average of the four replicates, to the nearest gram.

For the physiological surface smoothness measurement, which reports the PSS parameter, a sample of the paper tissue is selected which avoids wrinkles, tears, perforations, or gross deviations from macroscopic monoplanarity. The sample is conditioned at 22 to 24° C. and 48 to 52% relative humidity for at least two hours prior to testing. The sample is placed on a motorised table and magnetically secured in place. Either face of the sample may be selected for the measurement, provided all traces are taken from the same face.

Physiological surface smoothness is obtained by scanning the paper tissue sample in any direction with a profilometer to obtain the Z-direction displacement as a function of distance. The Z-direction displacement is converted to an amplitude versus frequency spectrum by a Fourier Transform. The spectrum is then adjusted for human tactile response using a series of filters. The peak heights of the filtered amplitude frequency curve are summed from 0 to 10 cycles per millimeter to give the result.

The paper tissue sample is approximately 100 millimeters×100 millimeters in size and mounted on a motorised table. While any suitable table will suffice, a table with surface tester model KES-FB-4NKES-SE, available from Kato Tech Company Limited of Koyota, Japan, or a CP3-22-01 DCI Mini Precision table using a NuStep 2C NuLogic Two Axis Stepper Motor Controller in the closed loop control mode have been found suitable. The table has a constant drive motor which travels at the rate of 1 millimeter per second. The sample is scanned 30 millimeters in the forward direction transversely indexed one millimeter, then reversed. Data are collected from the centre 26 millimeters of the scan in both the forward and reverse directions. The first and last 2 millimeters of each scan are ignored and not used in the calculations.

The profilometer has a probe with a tip radius of 2.54 microns and an applied force of 0.20 grams. The gauge range is calibrated for a total Z-direction displacement of 3.5 millimeters. Over the scan distance of the sample, the profilometer senses the Z-direction displacement of the stylus in millimeters. The output voltage from the gauge controller is digitised at a rate of at least 20 points per second. Over the entire 26 millimeter scan range, 512 pairs of time surface height data points are obtained for both the forward and reverse directions of a scan. The profilometer is mounted above the sample table such that the surface topography can be measured. A suitable profilometer is a EMD 4320 WI Vertical Displacement Transducer, having an EPT 010409 stylus tip, and an EAS 2351 Analog Amplifier. This equipment is obtainable from Federal Products of Providence, R.I.

The digitised data pairs are imported into a standard statistical analysis package for further analysis. Suitable software analysis packages included SAS of Cary, N.C., and preferably LabVIEW Instrument Control Software 3.1 available from National Instruments of Austin, Tex. When using the LabVIEW software, raw data pairs linking surface height and time from the individual scans are centered about the mean using the Mean.vi analysis tool in the LabVIEW software. The 512 data points from each of the 16 traces are converted to 16 amplitude spectra using the Amplitude and Phase Spectrum.vi tool. Each spectrum is then smoothed using the method described by the PROC Spectra Method of the SAS software. LabVIEW smoothing filter values of 0.000246, 0.000485, 0.00756, 0.062997, 0.00756, 0.000485, 0.000246 are utilized. The output from this tool is taken as the Amp Spectrum Mag (vrms).

The amplitude data are then adjusted for human tactile response using a series of frequency filters designed from Verrillo's data on vibrotactile thresholds as a function of vibration frequency as set forth in the Journal of Acoustical Society of America, in the article entitled "Effect Of Contactor Area On The Vibrotactile Threshold", Vol. 35, 1962 (1963). The aforementioned data are reported in a time domain as cycles per second and converted to the spatial domain in cycles per millimeter. The conversion factor and filter values are found in the procedure set forth in the 1991 International Paper Physics Conference, TAPPI Book 1, more particularly the article entitled "Methods For The Measurement Of The Mechanical Properties Of Paper tissue" by Ampulski, et al., and found at page 19, utilizing the specific procedure set forth at page 22 entitled "Physiological Surface Smoothness". The response from the filters are set at 0 below the minimum threshold and above the maximum response frequencies and varies from 0 to 1 therebetween as described by the aforementioned Ampulski et al. article.

The physiologically adjusted frequency amplitude data are obtained by multiplying the amplitude spectra described above by the appropriate filter value at each frequency. A typical amplitude spectrum and filtered amplitude spectrum are illustrated in FIG. 5 of the aforementioned Ampulski et al. article. The Verrillo-adjusted frequency amplitude curve is summed point by point between 0 and 10 cycles per millimeter. This summation is considered to be the physiological surface smoothness. The eight forward and eight reverse physiological surface smoothness values thus obtained are then averaged and reported in microns.

Physiological surface smoothness measurements using the SAS software is described in commonly assigned U.S. Pat No. 4,959,125, issued Sep. 25, 1990 to Spendel; U.S. Pat. No. 5,059,282, issued Oct. 22, 1991 to Ampulski et al.; U.S. Pat. No. 5,855,738, issued Jan. 5, 1999 to Weisman et al., and U.S. Pat. No. 5,980,691, issued Nov. 9, 1999 to Weisman et al.

Either face of the tissue may be selected for the smoothness measurement, provided all traces are taken from the same face. If either face of the tissue meets any of the smoothness criteria set forth herein, the entire sample of the tissue is deemed to fall within that criterion. Preferably both faces of the tissue meet the above criteria.

EXAMPLE

An aqueous slurry comprising 3% by weight of Nothern Softwood Kraft (NSK) fibres was prepared in a conventional re-pulper. The NSK slurry was refined gently and a 2% solution of the permanent wet strength resin (Kymene™ 617) was added to the NSK stock pipe at a rate of 0.9% by weight of the total dry fibres. The absorption of the permanent wet strength resin onto the NSK fibres is enhanced by an in-line mixer. A 1% solution of the dry strength resin (carboxymethyl cellulose) is added to the NSK stock before the fan pump at a rate of 0.14% by weight of the total dry fibres. The NSK slurry was diluted to about 0.2% consistency at the fan pump.

A chemical softening composition was prepared comprising di-hard tallow diethyl ester dimethyl quaternary ammonium chloride and polyoxyethylene glycol, having an average molecular weight of 400 (PEG400). The PEG400 was heated to about 66° C., and the quat was dissolved into the molten PEG400 so that a homogeneous mixture was formed.

An aqueous slurry comprising 3% by weight of eucalyptus fibres was prepared in a conventional re-pulper. A 1% solution of the chemical softening composition was added to the Eucalyptus stock pipe at a rate of 0.09% by weight of the total dry fibres. The Eucalyptus slurry was diluted to about 0.2% consistency at the fan pump. The 1% solution of the chemical softening composition was also added to the NSK slurry after post CMC addition and prior to dilution of the slurry to about 0.2% at the stock pump.

The two slurries were combined so that the ratio of NSK to eucalyptus fibres was 40:60 and the resulting slurry was deposited, by means of a single layer headbox onto a Fourdrinier wire to form an embryonic web. Dewatering occured through the Fourdrinier wire and was assisted by a deflector and vacuum boxes.

The embryonic web was transferred from the Fourdrinier wire, at a fibre consistency of about 20% at the point of transfer, to a conventional drying felt. The web was then transfered to the surface of a Yankee dryer with a sprayed creping adhesive comprising 0.25% aqueous solution of Polyvinyl Alcohol (PVA).

The fibre consistency was increased to an estimated 96% before dry creping the web with a doctor blade. The doctor blade had a bevel angle of about 25° and is positioned with respect to the Yankee dryer to provide an impact angle of about 81°. The Yankee dryer was operated at about 4 m/s and the dried, uncalendared paper was formed into 1 ply rolls at a reel.

Three of these 1-ply rolls were taken to an off-line rewinding operation to form 3-ply rolls that were subsequently converted into a 3-ply tissue paper product, having overall dimension of about 210 mm square.

The 3-ply rolls were produced by simultaneously unwinding 3 of the 1-ply rolls, running the centre ply through a rubber to steel bulk embossing operation and rewinding the two unembossed outer plies with the embossed centre ply to form a 3-ply roll. For the centre ply embossing a smooth rubber roll was loaded against a patterned steel roll. The patterned steel roll has raised elliptical emboss knobs about 1.7 mm deep having a major axis at the surface of about 2 mm and a minor axis of about 1 mm. The embossments are arranged in repeating pattern of concentric diamonds consisting of about 72 knobs in 900 square mm area.

The 3-ply roll was subsequently converted into a 3-ply tissue product. The three ply web was unwound and subjected to an embossing step before folding. The margin of the tissue paper product, extending about 15 mm in from the edge was embossed following the process described in WO95/27429, published on Oct. 19$^{th}$ 1995. The major part of the surface area of the tissue paper product (i.e. all of the surface area within the 15 mm margin) was unembossed. The tissue was further decorated by embossing the brand name over a small area of the previously unembossed area and four decorative leaf patterns where embossed in the previously unembossed area was also added.

Lotion was printed on each of the outer surfaces of the 3-ply web via a two step application process before folding. The lotion was an aqueous solution of di-hard tallow diethyl ester dimethyl quaternary ammonium chloride. The printing was accomplished by running the 3-ply web through two consecutive printing stations each consisting of an engraved anilox roll and a rubber backing roll pair.

The anilox roll was engraved to a cell volume of about 3 ml per square meter, and with supplied with lotion from a closed supply chamber designed to fill the engraved volume with lotion. A gap of 0.35 mm was established between the anilox roll and backing roll, and the 3-ply web was run through this gap, transferring lotion to the surface touching the anilox roll. The web was then run through the second printing station with an identical anilox/rubber roll pair at a 0.35 mm gap. The pairs were arranged such that the second anilox roll contacted the as yet unlotioned surface, transfering lotion to it. This arrangement transferred 0.45% active quat per dry weight of the finished 3-ply tissue.

The paper tissue obtained by the above described process had a basis weight of 54 g/m$^2$, a total caliper of 0.35 mm, a caliper per ply of 0.12 mm, a wet burst strength of 375 g and a PSS parameter of 620 micron.

A second example consists of substrate produced described above, in which the outer plies are run through a smoothing calendering roll. Calendering at 12 kN/m to 15 kN/m was found to further reduce the PSS parameter to about 500 to 450 microns.

What is claimed is:

1. A process for making a paper tissue, the process comprising the steps of:

a. unwinding at least two plies from a corresponding number of parent rolls;

b. bulk embossing at least one ply;

c. calendering at least one non-bulk embossed ply;

d. juxtaposing the at least one bulk embossed ply and the at least one non-bulk embossed ply to form a multi-ply tissue having a caliper, a caliper per ply, and a physiological surface smoothness parameter, wherein the caliper per ply is greater than 0.09 mm, and the physiological surface smoothness parameter is less than 700 microns.

2. The process according to claim 1, further comprising a step of applying a lotion to at least one of the plies.

3. The process according to claim 1, wherein at least three plies are unwound from a corresponding number of parent rolls.

4. The process of claim 1, further comprising a step of applying an adhesive to at least one of the plies.

5. The process according to claim 3 wherein the at least three plies are juxtaposed to form a multi-ply tissue such that at least one bulk embossed ply is positioned between two non-bulk embossed plies.

6. A paper tissue comprising at least two plies and having a caliper, a caliper per ply, and a physiological surface smoothness parameter, wherein the caliper per ply is greater than 0.09 mm, and the physiological surface smoothness parameter is less than 700 microns, and wherein at least one of the plies comprises a bulk embossing, and at least one of the plies does not comprise a bulk embossing.

7. The paper tissue according to claim 6 wherein the at least one ply that does not comprise a bulk embossing is calendered.

8. The paper tissue according to claim 6 wherein the bulk embossing comprises a pattern of embossed and unembossed areas, and wherein the ratio of the embossed areas to the unembossed areas is from 1:1 to 1:20.

9. The paper tissue according to claim 6 wherein the paper tissue comprises at least three plies.

10. The paper tissue according to claim 9 wherein the paper tissue comprises two outer plies and at least one inner ply positioned between the two outer plies, and wherein the outer plies do not comprise the bulk embossing, and the at least one inner ply does comprise the bulk embossing.

11. The paper tissue according to claim 10 wherein at least one of the two outer plies is calendered.

* * * * *